US005275287A

United States Patent [19]

Thompson

[11] Patent Number: 5,275,287

[45] Date of Patent: Jan. 4, 1994

[54] CLOSURES

[75] Inventor: Nigel Thompson, Stourbridge, United Kingdom

[73] Assignee: MCG Closures Ltd., West Midlands, United Kingdom

[21] Appl. No.: 37,531

[22] Filed: Mar. 26, 1993

Related U.S. Application Data

[63] Continuation of Ser. No. 863,764, Apr. 6, 1992.

[30] Foreign Application Priority Data

Apr. 10, 1991 [GB] United Kingdom ..... 9107515

[51] Int. Cl.[5] ..... B65D 53/00

[52] U.S. Cl. ..... 215/344; 215/341; 215/343; 215/354; 215/DIG. 1

[58] Field of Search ..... 215/341, 343, 344, 345, 215/354, DIG.

[56] References Cited

U.S. PATENT DOCUMENTS

| | | | |
|---|---|---|---|
| 3,055,526 | 9/1962 | Plunkett | 215/344 X |
| 3,069,040 | 12/1962 | Corsette . | |
| 3,074,579 | 1/1963 | Miller | 215/344 |
| 3,255,907 | 6/1966 | Eddy | 215/344 X |
| 3,370,732 | 2/1968 | La Vange | 215/344 |
| 3,441,161 | 4/1969 | Van Baarn | 215/344 X |
| 3,944,104 | 3/1976 | Watson . | |
| 4,090,631 | 5/1978 | Grussen . | |
| 4,210,251 | 7/1980 | Grussen | 215/329 |
| 4,322,012 | 3/1982 | Conti | 215/344 |
| 4,380,304 | 4/1983 | Anderson | 220/306 |
| 4,392,579 | 7/1983 | Uhlig et al. | 215/253 |
| 4,489,845 | 12/1984 | Aichinger et al. | 215/329 |
| 4,907,709 | 3/1990 | Abe et al. | 215/252 |

FOREIGN PATENT DOCUMENTS

| | | |
|---|---|---|
| 0076778 | 4/1983 | European Pat. Off. . |
| 2340865 | 9/1977 | France . |

*Primary Examiner*—Allan N. Shoap
*Assistant Examiner*—Vanessa Caretto
*Attorney, Agent, or Firm*—Michael D. Bednarek

[57] ABSTRACT

A molded screw-threaded plastics closure has depending from the underside of the top an annular sealing portion spaced inward of the skirt. The sealing portion includes a plug part with a sealing rib for engaging the internal surface of the neck of a container, a radially outwardly projecting flange above the plug part, and a waisted pivot part disposed between the flange and the top. As the closure is applied, the sealing rib first moves into sealing engagement with the bore of the neck of the container, and then the flange comes into engagement with the top of the neck of the container and causes the sealing portion to pivot outwards about the part to tighten the seal. An internal rib on the skirt engages the outer surface of the neck of the container to form a secondary seal. Forms of stop may be provided for limiting the movement of the closure and/or the pivotal deflection of the sealing portion to prevent over-tightening during application of the closure. Gaseous pressure within the container tends to increase the sealing pressure between the plug part and the bore, and the top of the container is suitably stiff to resist deformation by the pressure.

16 Claims, 3 Drawing Sheets

CLOSURES

This application is a continuation of application Ser. No. 07/863,764 filed Apr. 6, 1992.

This invention relates to closures and more particularly to plastics closures.

According to this invention there is provided a closure molded from a plastics material comprising a top, a depending skirt formed internally with a screw-thread, and an annular sealing portion depending from the underside of the top and spaced inwardly from the skirt, said sealing portion including a plug part for sealingly engaging the radially inner surface of the neck of a container to which the closure is to be applied, a radially outwardly projecting flange spaced away from the top for abutment with the upper end of the neck of such container and an annular hinge part between the flange and the top about which the plug part and the flange can pivot relative to the top.

The annular hinge part is preferably waisted.

The preferred plastics material is e.g. a suitably resilient polyethylene or polypropylene.

In one arrangement according to the invention, said plug part has a generally frusto-conical radially outer surface, the diameter of said surface increasing progressively in a direction towards the top. Additionally or alternatively the plug part may have one or more circumferential sealing ribs on said radially-outer surface.

Stop means may be provided for limiting the radially outward pivotal movement of the sealing portion about said annular hinge. The stop means may be constituted by an annular formation disposed in the space between the skirt and the sealing portion and adapted for engagement by said flange in said outward pivotal movement of the sealing portion. Stop means, where provided, is preferably in the form of a series of circumferentially spaced projections formed on the underside of the top in the annular space between the skirt and the sealing portion for engagement by said flange. The flange may be buttressed by having a chamfered upper surface and the projections may have a complementary chamfered surface for abutment with the chamfered surface of the flange.

Alternatively, the projections may be shaped to come into abutment with a radially outer part of the top of the neck of the container to limit tightening movement of the closures. In yet another arrangement the projections may be shaped to limit both movement of the closure on to the container and outward pivotal movement of the flange.

Figure 1:
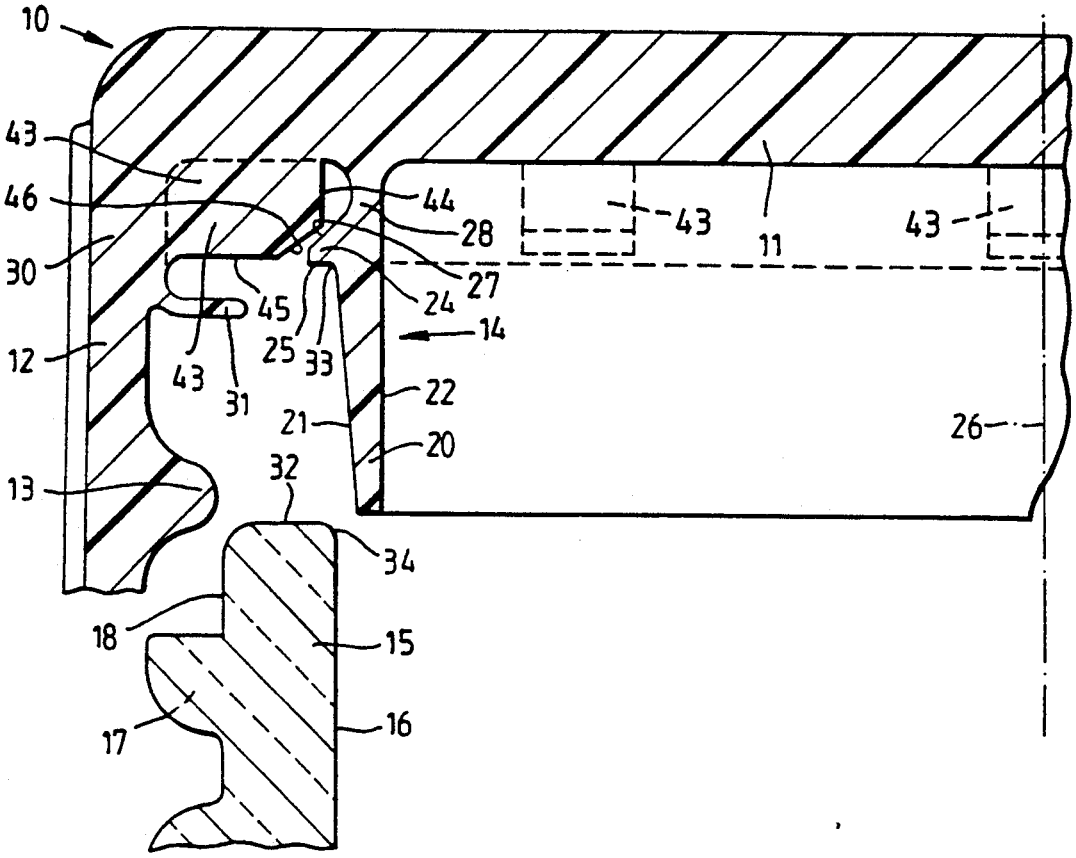
Figure 2:
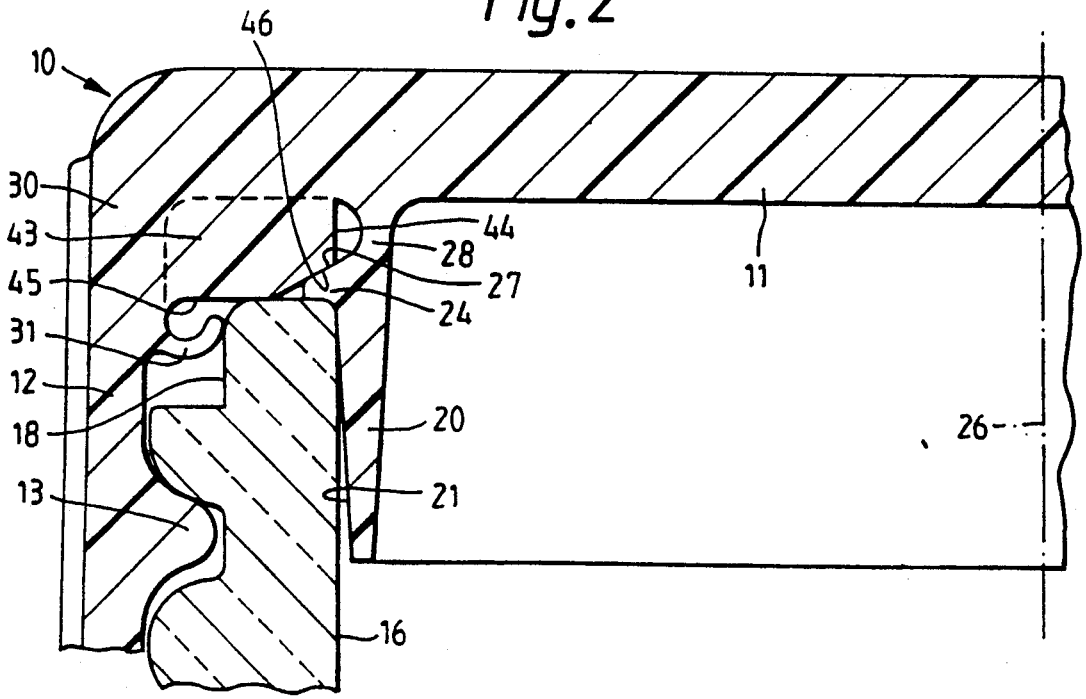
Figure 3:
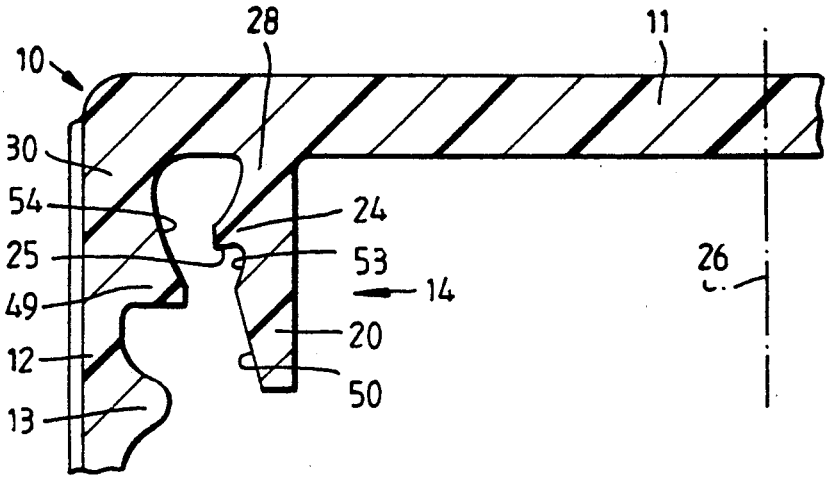
Figure 4:
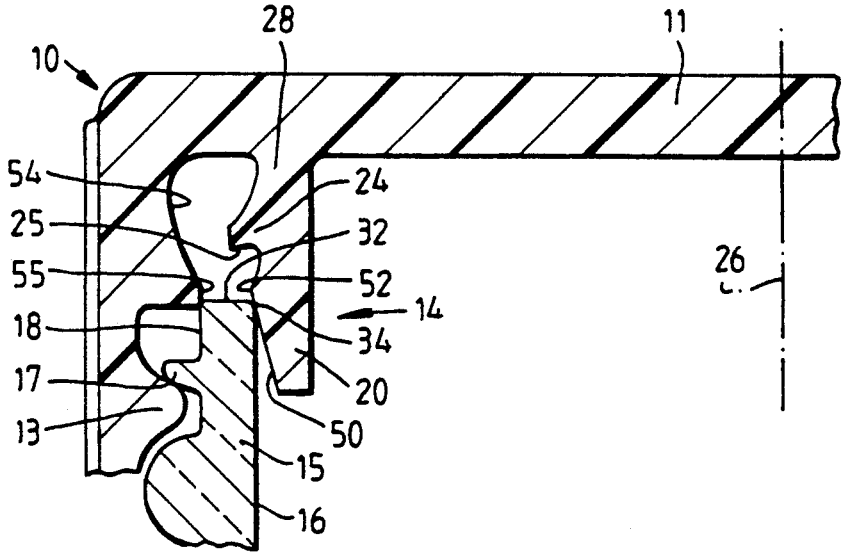
Figure 5:
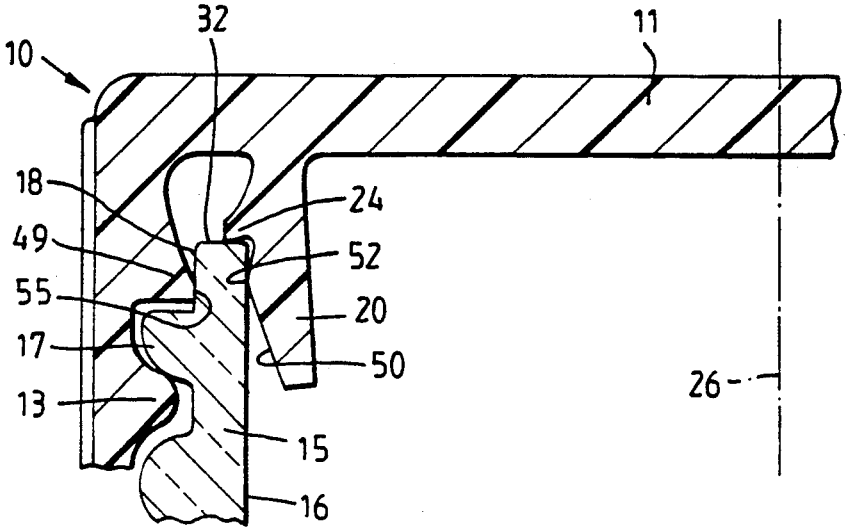
Figure 6:
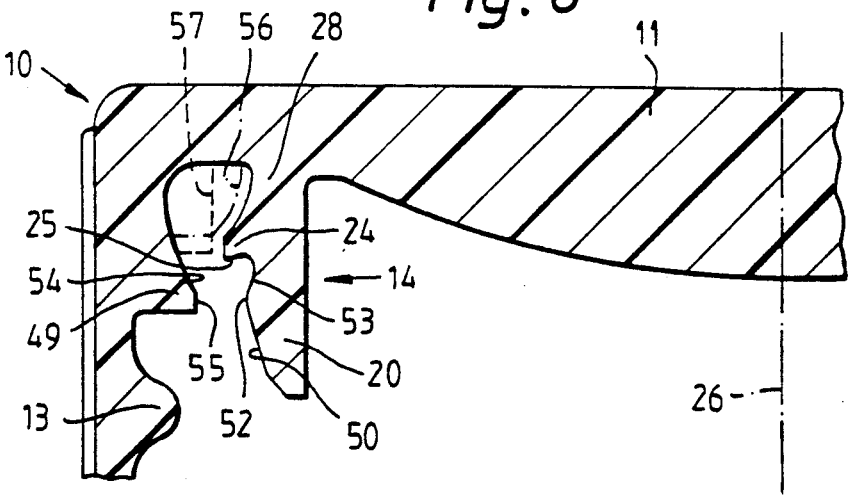

The invention will now be described in more detail with reference by way of example to the accompanying drawings in which:

FIG. 1 shows in fragmentary axial section a closure according to the invention about to be applied to a container, FIG. 2 shows the closure of FIG. 1 applied to the container, FIG. 3 shows in fragmentary axial section a further form of closure according to the invention prior to its application to a container, FIG. 4 shows the closure of FIG. 3 being applied to the container, FIG. 5 shows the closure of FIG. 3 applied to the container, and FIG. 6 illustrates further forms of closure according to the invention.

Corresponding parts in the various embodiments in the drawings are indicated by the same reference numeral.

Referring first to FIGS. 1 and 2, a closure 10 is shown which is molded in one piece from a resilient plastics material. The closure comprises a top 11, a depending skirt 12 formed with an internal screw-thread 13, and an annular sealing portion 14 projecting downward from the underside of the top. The neck 15 of the container to which the closure is to be applied has an internal surface 16 which is substantially cylindrical, an external surface formed with a screw-thread 17 corresponding to the screw-thread 13 on the closure and a cylindrical surface 18 above the screw-thread.

The sealing portion 14 includes an annular plug part 20, a radially outwardly projecting annular flange 24 and an annular hinge part 28 between the flange 24 and the top. Plug part 20 has a radially outer surface 21 which is conically inclined downwardly and inwardly at an included angle of about 10° in this instance, and a radially inner surface 22 which is substantially cylindrical. The lower surface 25 of flange 24 extends substantially at right angles to the central axis 26 of the closure. The upper surface 27 of flange 24 is inclined upward and radially inward. The annular hinge part 28 is waisted in section.

The region of the skirt 12 adjoining the top 11 is thickened at 30 on its radially inner side, and a sealing fin 31 projects radially inward flush with the lower face of the thickened part 30 and somewhat below the lower face 25 of flange 24.

A number of circumferentially-spaced stops 43 are formed at the junction between the top 11 and the skirt 12, projecting into the annular gap between the thickened part 30 of the skirt and the sealing portion 14. In one example there are eight such stops 43 evenly spaced apart at 45° C. intervals and each having an angular extent of approximately 5° about the axis 26. Each stop has a radially inner face 44 spaced from the waisted part 28, an axial face 45 disposed at a higher level than the surface 25 of flange 24, and a chamfered face 46 extending substantially parallel to or at a slightly lesser angle to the horizontal than the inclined top face 27 of the flange 24.

As the closure is applied to the container, the lower end of the plug part 20 enters easily into the neck of the container and assists in centralising the closure relative to the container in the initial stage. As the closure is screwed home, the upper portions of the frusto-conical surface 21 come into sealing engagement with the internal surface 16 of the neck and the end 32 of the neck comes into sealing abutment with the flange 24. The flange 24 is rendered stiff by the buttressing effect arising from the shape of its upper surface 27, so that as the closure is tightened, this abutment causes the flange and the sealing portion 14 to pivot radially outward about the annular hinge 28 so as to pivot the plug part into tighter sealing engagement in the neck and to increase the axial length of sealing contact between the frusto-conical face 21 and the inner surface 16 of the neck.

In the fully applied condition of the closure as shown in FIG. 2, the inclined face 27 of the flange comes into abutment with the chamfered faces 46 of the stops so as to limit the pivotal movement of the sealing portion 14 about the waisted part 28 and the bottom faces 45 of the stops abut the radially outer part of the end face 32 of the container to prevent over-tightening. In this condition, a primary seal extends from the corner portion 33 which co-operates with the inner corner 34 of the neck to a position part way down the plug.

During application of the closure, the annular fin 31 comes into engagement with the outer corner portion of the neck to form a secondary seal.

The closure is particularly useful in relation to containers for liquids under gaseous pressure, such as carbonated beverages, since the pressure in the container acts in a radially outward direction on the part of the internal surface of the plug part between the top and the lowest point of sealing contact between the plug part 20 and the internal surface of the neck and thus operates to tighten the seal.

The top 11 of the closure is made stiff to minimise upward deflection of the top under such gaseous pressure.

In the arrangement shown in FIGS. 3 to 5 the radially outer face of the plug part 20 has a surface portion 50, which is conically inclined downwardly and inwardly. The angle of inclination is substantially 15° to the inner surface of the plug part in the illustrated construction. The upper end of the portion 50 defines a sealing rib 52, the area 53 between the sealing rib 52 and the annular flange 24 being relieved.

An annular inwardly projecting rib 49 on the inner surface of the skirt provides a radially inwardly facing sealing surface 55 located at a distance from the top 11 axially greater than the distance of the sealing rib 52 from the top 11. The rib has its side 54 nearer the top of buttress form and has its side 49 remote from the top facing axially away from the top.

Again, the top 11 is made stiff to minimise upward deflection of the top under gaseous pressures within the container.

In operation, the closure is first guided into generally correct alignment with the container by the annular conical portion 50. When the end of the neck reaches the sealing surface 55 of rib 49, surface 55 acts as a final guide to ensure correct alignment of the closure before the main sealing rib 52 reaches the neck of the container. The correct alignment before engagement of the sealing rib 52 and the container ensures that the main sealing rib is not subjected to any adverse initial application forces. Possible damage to the sealing portion 14 during application of the closure is therefore minimised. When the rib 52 engages the container the sealing portion 14 pivots radially inwards about the waisted part 28 until the annular flange 24 engages the top of the neck of the container. Further tightening causes the sealing portion 14 to pivot radially outwards about the waisted part 28 so that the sealing force of the sealing rib 52 against the inner surface 16 of the neck is magnified by the moment of the application force about the pivot provided by the waisted part 28.

The sealing rib 49 forms a secondary seal against the cylindrical radially outer surface 18 of the container neck.

FIG. 6 shows a modified form of the closure of FIGS. 3 to 5 and illustrates two forms of stop 56, 57 designed to prevent over-tightening of the closure. As in the construction of FIGS. 1 and 2, the stops are circumferentially spaced about the axis 26.

If the type of stop 56 is incorporated in the closure then when the closure is fully applied the stops will abut the upper surface of the annular flange 24 and limit the radially outward pivotal movement of the sealing portion 14 about the waisted part 28 and also prevent over-tightening. Stops 57 differ slightly in operation in that they prevent over-tightening by limiting downward movement of the closure relative to the container.

All of the closures described herein may have a tamper-evident ring if desired.

The closures described are particularly but by no means exclusively useful in association with plastics containers. The exposed parts of the neck finish of plastics containers are prone to scratch marks, occurring for example in handling, and such marks may prevent formation of an effective seal where they extend across a part of the finish intended to be a sealing surface.

The stiff top 11 has the incidental advantage of enabling the closure to be used for containers intended to be stored in so-called half-crates which leave the upper halves of the containers unprotected. When half-crates of containers are stacked one upon the other, the weight falls upon the tops of the closures of the containers in the lower half-crates, and it is consequently desirable that the tops should be stiff to withstand the resulting stresses.

I claim:

1. A closure for application to a container which includes a neck having an axially facing upper end and a radially inner surface, the closure being molded from a plastics material and comprising a stiff top having an underside, a depending skirt formed internally with a screw-thread, an annular sealing portion depending from the underside of the top and spaced inwardly from the skirt, said sealing portion including a plug part having a radially outer surface for sealingly engaging the radially inner surface of the neck of the container to which the closure is to be applied, said plug part having a means for axial abutment with said axially facing upper end, said abutment means comprising a flange projecting radially outward beyond the plug part and spaced away from the top, said flange having a surface facing axially away from the top and substantially parallel with the top for said axial abutment, and a waisted annular hinge part between the flange and the top about which hinge part the annular sealing portion comprising the flange and the plug part can pivot radially outward as a result of force exerted on the flange by said upper end of the neck on occurrence of such abutment.

2. A closure as claimed in claim 1, wherein said plug part has a generally frusto-conical radially outer surface, said surface having a diameter which increases progressively in a direction towards the top.

3. A closure as claimed in claim 1, wherein the plug part has at least one circumferential sealing rib on said radially outer surface.

4. A closure as claimed in claim 3, wherein the radially outer surface of the plug part is relieved at a location adjacent the flange.

5. A closure as claimed in claim 1, wherein the flange has a side facing generally toward the top, at which side the flange is buttressed.

6. A closure as claimed in claim 1, wherein the skirt of the closure has a radially-inwardly projecting annular sealing element for engaging a radially outer surface of the neck of the container.

7. A closure as claimed in claim 6, wherein said sealing element is a rib having a radially inner face adapted for sealing engagement with a cylindrical surface of the neck of the container.

8. A closure as claimed in claim 6, wherein said sealing element is a flexible fin having a radially inner end which is adapted for sealing engagement with an outer corner portion of said upper end of the neck.

9. A closure as claimed in claim 1, further comprising stop means on the underside of the top radially between the sealing portion and the skirt for abutting a radially outer part of said upper end of the neck of the container to limit tightening movement of the closure.

10. A closure as claimed in claim 1, further comprising stop means on the underside of the top radially between the sealing portion and the skirt which stop means is arranged to limit radially outward pivotal movement of the flange about said annular hinge during application of the closure to a container.

11. A closure for application to a container which includes a neck having an axially facing upper end, a cylindrical external surface and a radially inner surface, the closure being molded from a plastics material and comprising a stiff top having an underside, a depending skirt formed internally with a screw-thread, and an annular sealing portion depending from the underside of the top and spaced inwardly from the skirt, said sealing portion including a plug part having a radially outer surface for sealingly engaging the radially inner surface of the neck of the container to which the closure is to be applied, said plug part having a means for axial abutment with said axially facing upper end, said abutment means comprising a flange projecting radially outward beyond the plug part and spaced away from the top, said flange having a surface facing axially away from the top and substantially parallel with the top, for said axial abutment, and an annular hinge part between the flange and the top about which the annular sealing portion comprising the flange and the plug part can pivot radially outward as a result of axial force exerted on the flange by said upper end of the container on such abutment, and the skirt having inwardly projecting guide means for engaging a cylindrical external surface of the neck of a container for aligning the plug part centrally relative to the neck of the container and absorbing lateral forces generated during application of the closure.

12. A closure as claimed in claim 11, wherein the neck of the container has a radially outwardly facing cylindrical surface and said guide means forms a secondary seal with said cylindrical surface.

13. In a closure for application to a container which includes a neck having a radially inner surface and a top with an upper end and a radially outer part, the closure being molded from a plastics material and comprising a stiff top having an underside, a depending skirt formed internally with a screw-thread, and an annular sealing portion depending from the underside of the top and spaced inwardly from the skirt, said sealing portion including a plug part having a radially outer surface for sealingly engaging the radially inner surface of the neck of the container to which the closure is to be applied, said plug part having a means for axial abutment with said axially facing upper end, said abutment means comprising a flange projecting radially outward beyond the plug part and spaced away from the top, said flange having a surface facing axially away from the top and substantially parallel with the top, for said axial abutment, and an annular hinge part between the flange and the top about which the annular sealing portion comprising the flange and the plug part can pivot radially outward as a result of axial force exerted on the flange by said upper end of the neck on occurrence of said abutment, and stop means on the underside of the top radially between the sealing portion and the skirt for abutting a radially outer part of said upper end of the neck of the container to limit tightening movement of the closure.

14. A closure as claimed in claim 13, wherein the stop means is formed in a series of circumferentially spaced sections.

15. In a closure for application to a container which includes a neck having an upper end and a radially inner surface the closure molded from a plastics material and comprising a stiff top having an underside, a depending skirt formed internally with a screw-thread, and an annular sealing portion depending from the underside of the top and spaced inwardly from the skirt, said sealing portion including a plug part having a radially outer surface for sealingly engaging the radially inner surface of the neck of a container to which the closure is to be applied, a flange projecting radially outward beyond the plug part and spaced away from the top, said flange having a surface facing axially away from the top, for axial abutment with the upper end of the neck of said container, and an annular hinge part between the flange and the top about which hinge part the annular sealing portion comprising the flange and the plug part can pivot relative to the top as a result of force exerted on the flange by said upper end of the neck on said abutment, and stop means on the underside of the top radially between the sealing portion and the skirt which stop means is arranged to limit radially outward pivotal movement of the parts of the sealing portion between the flange and the top about said annular hinge during application of the closure to a container.

16. A closure as claimed in claim 15, wherein the stop means is formed in a series of circumferentially spaced sections.

* * * * *